US006607269B2

(12) United States Patent
Sumioka et al.

(10) Patent No.: US 6,607,269 B2
(45) Date of Patent: Aug. 19, 2003

(54) INK-JET RECORDING MATERIAL

(75) Inventors: Koichi Sumioka, Tokyo (JP); Kozo Haino, Tokyo (JP); Hiroshi Sakaguchi, Tokyo (JP); Yukihiro Suzuki, Tokyo (JP); Yukio Tokunaga, Tokyo (JP); Masahiro Hanmura, Nagano (JP); Hiroyuki Onishi, Nagano (JP)

(73) Assignees: Mitsubishi Paper Mills Limited, Tokyo (JP); Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/023,855

(22) Filed: Dec. 21, 2001

(65) Prior Publication Data

US 2002/0140796 A1 Oct. 3, 2002

(30) Foreign Application Priority Data

| | | |
|---|---|---|
| Dec. 28, 2000 | (JP) | 2000-400654 |
| Mar. 12, 2001 | (JP) | 2001-067926 |
| Aug. 14, 2001 | (JP) | 2001-245997 |

(51) Int. Cl.[7] ..... B41J 2/01
(52) U.S. Cl. ..... 347/105; 428/195
(58) Field of Search ..... 347/105, 101; 428/195, 328

(56) References Cited

U.S. PATENT DOCUMENTS 6,329,113 B1 * 12/2001 Bourdelais et al. ..... 347/105

FOREIGN PATENT DOCUMENTS

| | | | |
|---|---|---|---|
| EP | 0803374 A2 * | 10/1997 | ..... B41M/5/00 |
| EP | 1 034 940 | 9/2000 | |
| JP | 61-154989 | 7/1986 | |
| JP | 07-314881 | 12/1995 | |

* cited by examiner

*Primary Examiner*—Craig Hallacher
*Assistant Examiner*—Manish S. Shah
(74) *Attorney, Agent, or Firm*—Paul E. White, Jr.; Manelli Denison & Selter PLLC

(57) ABSTRACT

There is disclosed an ink-jet recording material including a water resistant support, and a porous ink-receptive layer containing inorganic fine particles having an average particle size of primary particles of 30 nm or less provided on the support, wherein the ink-jet recording material contains at least one hydrazine compound.

45 Claims, No Drawings

INK-JET RECORDING MATERIAL

BACKGROUND OF THE INVENTION

1. Field of the Invention

The present invention relates to an ink-jet recording material, particularly to an ink-jet recording material that has photo-like high glossiness, is excellent in ink-absorption property, and is improved in preservability after printing, and an ink-jet recording method.

2. Prior Art

As a recording material to be used for an ink-jet recording method, it has been known a recording material which comprises an ink-receptive layer made of a hydrophilic polymer or a porous ink-receptive layer containing a pigment such as amorphous silica, etc. and a hydrophilic polymer, being provided on a support such as a usual paper or the so-called ink-jet recording sheet.

There have been proposed recording materials obtained by coating a silicon-containing pigment such as silica, etc., with an aqueous binder onto a paper support as disclosed in, for example, Japanese Provisional Patent Publications No. 51583/1980, No. 157/1981, No. 107879/1982, No. 107880/1982, No. 230787/1984, No. 160277/1987, No. 184879/1987, No. 183382/1987, No. 11877/1989, No. 21508/1991, No. 67986/1992 and the like.

Also, in Japanese Patent Publication No. 56552/1991, Japanese Provisional Patent Publications No. 188287/1990, No. 132728/1996, No. 81064/1998, No. 119423/1998, No. 175365/1998, No. 193776/1998, No. 203006/1998, No. 217601/1998, No. 20300/1999, No. 20306/1999 and No. 34481/1999, and the like, there have been disclosed ink-jet recording materials using synthetic silica fine particles prepared by a gas phase process (hereinafter referred to as "fumed silica"). Ultrafine particles having an average particle size of the primary particle of 30 nm or less, particularly fumed silica have characteristics that they give a recording material having good ink absorption property and high glossiness. In recent years, a recording sheet having characteristics like photography has earnestly been desired. Recording materials in which an ink-receptive layer mainly comprising fumed silica had been coated on a water-resistant support such as a polyolefin resin-coated paper (a polyolef in resin such as polyethylene, etc., is laminated on the both surfaces of paper) and a polyester film have been proposed.

A paper support which has conventionally been used in general has itself a role of an ink-receptive layer. However, different from a paper support, the water-resistant support such as a polyolefin resin-coated paper, etc. cannot absorb ink so that it is important that an ink-receptive layer provided on the support has a high ink absorption property whereby it is necessary to heighten voids of the ink-receptive layer. Accordingly, to prepare a recording sheet using a water-resistant support, it is necessary to increase an amount of the fumed silica to be coated, and further to reduce a ratio of a binder to the fumed silica.

However, in ink-jet recording materials having high voids using ultrafine particle fumed silica, whereas its ink-absorption property is extremely excellent, there are problems that its light resistance is poor or a printed image likely discolors during preservation after printing. That is, in a recording medium having a void layer of fumed silica, a problem of poor light resistance, particularly a problem of likely causing discoloration due to a minute amount of a gas in air is not yet sufficiently resolved.

Compounds which have been known as an agent for preventing discoloration due to a minute amount of a gas or a light resistance-improving agent cannot improve both of gas resistance (an effect of preventing discoloration due to a minute amount of a gas) and light resistance simultaneously when they are added to a porous ink-receptive layer comprising ultrafine silica particles since there is an effect of preventing discoloration due to a minute amount of a gas but light resistance becomes poor, or else gas resistance becomes poor while light resistance is improved. Thus, it is the present status that there is little compound which improves both of gas resistance and light resistance simultaneously.

In Japanese Provisional Patent Publication No. 25796/1996, there is disclosed that gas resistance can be improved by adding a compound such as a thiourea derivative, etc., to a porous ink-receptive layer comprising pseudo-boehmite. Gas resistance is certainly improved with a great extent when thiourea is added to the porous ink-receptive layer comprising ultrafine silica particles, and light resistance is also improved with a certain extent. However, the thiourea derivatives are supposed to have bad effects on human body so that its use is limited.

In Japanese Provisional Patent Publication No. 314882/1995, there is disclosed that gas resistance can be improved by adding a compound such as a dithiocarbamate, etc., to a porous ink-receptive layer comprising pseudo-boehmite. However, even when dithiocarbamic acid is added to the porous ink-receptive layer comprising ultrafine silica particles, gas resistance is not improved and light resistance becomes worse.

In Japanese Provisional Patent Publication No. 314881/1995, there is disclosed that yellow discoloration at the time of contacting with a polyvinyl chloride film can be prevented by adding a urea derivative, a semicarbazide derivative, a carbohydrazide derivative or a hydrazine derivative to a porous ink-receptive layer comprising pseudo-boehmite. However, even when urea is added to the porous ink-receptive layer comprising ultrafine silica particles, both of gas resistance and light resistance can be hardly improved.

Also, in Japanese Provisional Patent Publication No. 154989/1986, there is disclosed that light resistance can be improved by adding a hydrazide series compound to an ink-receptive layer comprising synthetic silica, but there is no description to improve gas resistance.

SUMMARY OF THE INVENTION

Accordingly, an object of the present invention is to provide a material for an ink-jet recording that has photo-like high glossiness, high ink-absorption capacity and high water resistance, and is improved in preservability.

The above objects of the present invention can be accomplished by an ink-jet recording material which comprises a water resistant support, and a porous ink-receptive layer containing inorganic fine particles having an average particle size of a primary particle of 30 nm or less provided on the support, wherein said ink-jet recording material contains at least one hydrazine compound.

DESCRIPTION OF THE PREFERRED EMBODIMENTS

The preferred ink-jet recording material of the present invention is characterized in that it can absorb ink in voids in the film formed by fumed silica, and in order to realize high ink-absorption capacity, it is necessary to increase a void volume. Therefore, it is necessary to coat a relatively large amount of the fumed silica on the support, and when a hydrophilic binder is used, its amount is preferably reduced to increase the voids (or a void ratio).

The fumed silica with ultrafine particles to be preferably used in the present invention is preferably added to an ink-receptive layer in an amount of 8 g/m$^2$ or more, more preferably in the range of about 10 to 30 g/m$^2$. If the amount is less than the above range, ink-absorption capacity is deteriorated. An amount of the hydrophilic binder is preferably in the range of 10 to 40% by weight based on the amount of the fumed silica fine particles. By decreasing the ratio of the hydrophilic binder as mentioned above, ink-absorption capacity is improved but water resistance, and light resistance and gas resistance after printing are likely deteriorated. The present invention satisfies these properties simultaneously.

In the present invention, the fumed silica fine particles are preferably contained in an ink-receptive layer as a main component. That is, an amount of the inorganic (or fumed silica) fine particles is preferably 50% by weight or more, more preferably about 60% by weight or more, further preferably about 65% by weight or more based on the total weight of the whole solid components in the ink-receptive layer.

Fumed silica to be used in the present invention is also called to as the drying method silica relative to the wet type method, and it can be generally prepared by a flame hydrolysis method. More specifically, it has been known a method in which silicon tetrachloride is burned with hydrogen and oxygen. In this method, silanes such as methyl trichlorosilane, trichlorosilane, etc., may be used alone in place of silicon tetrachloride or in combination with silicone tetrachloride. The fumed silica is commercially available from Nippon Aerosil K.K. (Japan) under the trade name of Aerosil, and K.K. Tokuyama (Japan) under the trade name of QS type, etc.

An average particle size of the primary particles of the inorganic fine particles, particularly fumed silica to be used in the present invention is less than 30 nm. Preferably those having an average particle size of the primary particles of 3 to 20 nm and a specific surface area measured by the BET (Brunauer-Emmett-Teller) method of 200 m$^2$/g or more are used. The BET method herein mentioned means one of methods for measuring a surface area of powder material by a gas phase adsorption method and is a method of obtaining a total surface area possessed by 1 g of a sample, i.e., a specific surface area, from an adsorption isotherm. As an adsorption gas, a nitrogen gas has frequently been used, and a method of measuring an adsorption amount obtained by the change in pressure or a volume of a gas to be adsorbed has most frequently been used. Most frequently used equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

In the present invention, as the hydrophilic binder to be preferably used with the fumed silica with ultrafine particles, conventionally known various binders can be used, and a hydrophilic binder which has high transparency and gives high permeability is preferably used. For using the hydrophilic binder, it is important that the hydrophilic binder does not clog the voids by swelling at the initial stage of permeation of ink. From this point of view, a hydrophilic binder having a relatively low swellability at around the room temperature is preferably used. A particularly preferred hydrophilic binder is a completely or partially saponified polyvinyl alcohol or a cationic-modified polyvinyl alcohol.

Among the polyvinyl alcohols, particularly preferred is partially or completely saponified polyvinyl alcohol having a saponification degree of 80% or more. Those having an average polymerization degree of 200 to 5,000 are preferably used.

Also, as the cationic-modified polyvinyl alcohol, there may be mentioned, for example, a polyvinyl alcohol having a primary to tertiary amino groups or a quaternary ammonium group at the main chain or side chain of the polyvinyl alcohol as disclosed in, for example, Japanese Provisional Patent Publication No. 10483/1986.

In the present invention, it is preferred to use, in combination with the hydrophilic binder, a cross-linking agent (film hardening agent) of said binder. Specific examples of the cross-linking agent may include an aldehyde type compound such formaldehyde and glutaraldehyde; a ketone compound such as diacetyl and chloropentanedione; bis(2-chloroethylurea)-2-hydroxy-4,6-dichloro-1,3,5-triazine, a compound having a reactive halogen as disclosed in U.S. Pat. No. 3,288,775; divinylsulfone; a compound having a reactive olefin as disclosed in U.S. Pat. No. 3,635,718; a N-methylol compound as disclosed in U.S. Pat. No. 2,732,316; an isocyanate compound as disclosed in U.S. Pat. No. 3,103,437; anaziridine compound as disclosed in U.S. Pat. Nos. 3,017,280 and 2,983,611; a carbodiimide type compound as disclosed in U.S. Pat. No. 3,100,704; an epoxy compound as disclosed in U.S. Pat. No. 3,091,537; a halogen carboxyaldehyde compound such as mucochloric acid, a dioxane derivative such as dihydroxydioxane, an inorganic cross-linking agent such as chromium alum, zirconium sulfate, boric acid and a borate, and they may be used independently or in combination of two or more. Among these, boric acid and a borate are particularly preferred.

According to the preferred embodiment of the present invention, water resistance and preservability after printing can be markedly improved by containing a hydrazine compound in the ink-receptive layer having a surface pH of 3 to 6, preferably 3 to 5.5 in combination with the fumed silica.

According to the another preferred embodiment of the present invention, water resistance and preservability after printing can be further markedly improved by containing a cationic compound and a hydrazine compound in the ink-receptive layer having a surface pH of 3 to 6, preferably 3 to 5.5 in combination with the fumed silica.

The hydrazine compound to be used in the present invention is preferably represented by the following formula (1):

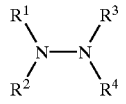

(1)

wherein $R^1$ to $R^4$ each independently represents a hydrogen atom, a substituted or unsubstituted aliphatic group, an aromatic group, a heterocyclic group, a carbonyl group, a sulfonyl group, a sulfoxy group, a phosphoryl group, or an iminomethylene group, each of which may be bonded to form a ring, or may form a polymer.

As the above-mentioned substituent, there may be mentioned, for example, an alkyl group, an aryl group, a heterocyclic group, an alkoxy group, an amino group, a hydrazino group, a carbonyl group, a carbamoyl group, and the like, and these substituents may be further substituted by at least one of the other substituent(s).

Among the hydrazine compounds, those having at least one substituted or unsubstituted carbonyl group or sulfonyl group as at least one of $R^1$ to $R^4$ are particularly preferred. As the hydrazine compound to be used in the present invention, the following compounds can be exemplified.

(1)

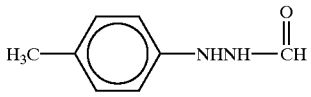

(2)

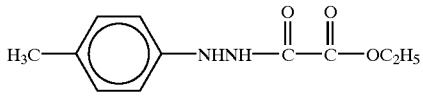

(3)

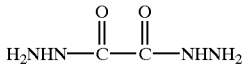

(4)

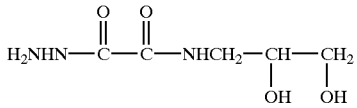

(5)

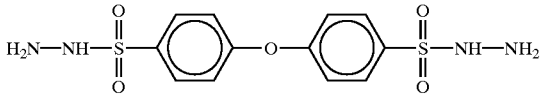

(6)

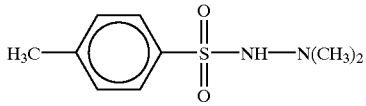

(7)

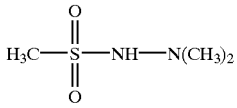

(8)

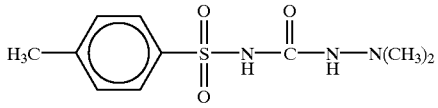

(9)

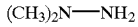

(10)

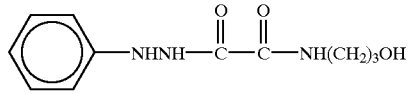

(11)

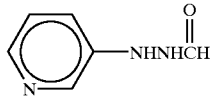

(12)

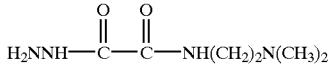

(13)

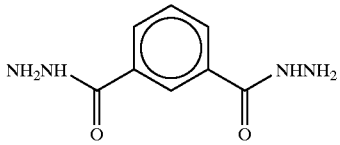

(14)

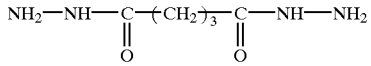

(15)

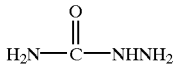

(16)

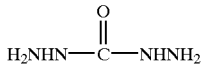

(17)

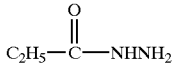

(18)

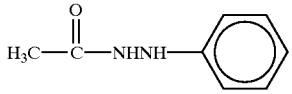

(19)

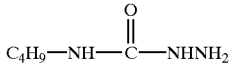

(20)

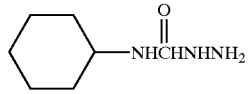

(21)

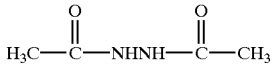

(22)

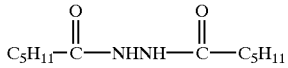

(23)

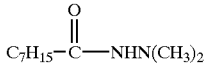

(24)

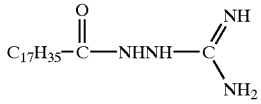

-continued (25)

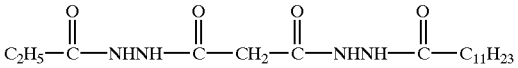

(26)

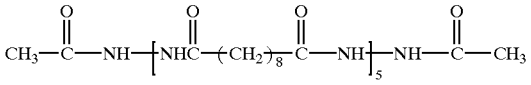

(27)

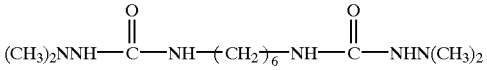

(28)

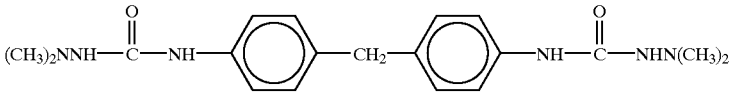

(29)

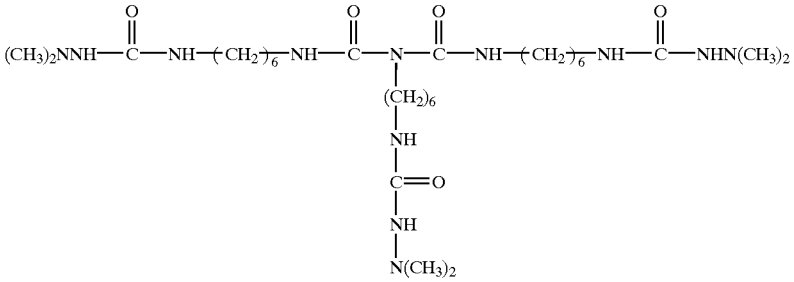

(30)

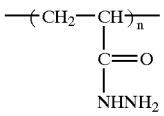

(31)

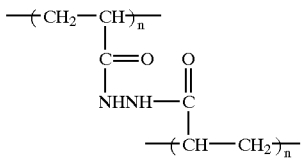

An amount of the hydrazine compound to be used in the ink-receptive layer of the present invention is preferably about 0.1 to 50 mmol/$m^2$, more preferably about 0.2 to 20 mmol/$m^2$.

As the cationic compound to be preferably used in the present invention, there may be mentioned, for example, a cationic polymer and a water-soluble metallic compound. As the cationic polymer to be used in the present invention, there may be preferably mentioned polyethyleneimine, polydiallylamine, polyallylamine, polyalkylamine, as well as polymers having a primary to tertiary amino group or a quaternary ammonium group as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/1988, No. 115780/1988, No. 280681/1988, No. 40371/1989, No. 234268/1994, No. 125411/1995 and No. 193776/1998, etc. An average molecular weight (Mw) of these cationic polymers is preferably 5,000 or more, more preferably in the range of 5,000 to 100,000.

In the ink-jet recording material of the present invention, high light resistance and gas resistance which cannot be accomplished by increasing amounts of the respective components can be accomplished by using a dicyandiamide resin in combination with the hydrazine compound.

As the dicyandiamide resin, there may be mentioned, for example, dicyandiamide polyalkylene polyamine condensate, dicyandiamide formalin condensate and the like, and it may be commercially available under the trade names of Neofix RP-70Y available from Nicca Kagaku K.K., Japan, Jetfix 20 available from Satoda Kako K.K., Japan, Sanfix 70 available from Sanyo Kasei K.K., Japan, Nikaflock D1000 available from Nippon Carbide K.K., Japan, Jetfix 105 available from Satoda Kako K.K., Japan, and the like.

An amount of these cationic polymers is preferably about 0.1 to 20% by weight, more preferably about 1 to 10% by weight based on the amount of the inorganic fine particles.

The water-soluble metallic compound to be used in the present invention may include, for example, a water-soluble polyvalent metallic salt. As such a salt, there may be mentioned a water-soluble salt of a metal selected from the group consisting of calcium, barium, manganese, copper, cobalt, nickel, aluminum, iron, zinc, zirconium, titanium, chromium, magnesium, tungsten, and molybdenum. More specifically, such a water-soluble metallic compound may include, for example, calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, amide nickel sulfate tetrahydrate, aluminum sulfate, aluminum sulfite, aluminum thiosulfate, poly-(aluminum chloride), aluminum nitrate nonahydrate, aluminum chloride hexahydrate, ferrous bromide, ferrous chloride, ferric chloride, ferrous sulfate, ferric sulfate, zinc bromide, zinc chloride, zinc nitrate hexahydrate, zinc sulfate, zirconium acetate, zirconium chloride, zirconium oxychloride octahydrate, zirconium hydroxychloride, chromium acetate, chromium sulfate, magnesium sulfate, magnesium chloride hexahydrate, magnesium citrate nonahydrate, sodium phosphorus wolframate, tungsten sodium citrate, dodecawolframatophosphate n hydrate, dodecawolframatosilicate 26 hydrate, molybdenum chloride, dodecamolybdatephosphate n hydrate, etc.

In the present invention, a water-soluble aluminum compound or a water-soluble compound containing an element of Group 4A (Group 4) of the periodic table is particularly preferably used. The water-soluble aluminum compound may include, for example, aluminum chloride and its hydrate, aluminum sulfate and its hydrate, aluminum alum, etc. as an inorganic salt thereof. Moreover, there is a basic poly(aluminum hydroxide) compound which is an inorganic aluminum-containing cationic polymer. Of these, a basic poly(aluminum hydroxide) compound is particularly preferably used.

The above-mentioned poly(aluminum hydroxychloride) compound is a water-soluble poly(aluminum hydroxide) a main component of which is represented by the following formula (2), (3) or (4), and which contains a polynuclear condensed ion which is basic and a polymer in a stable form, such as $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

$$[Al_2(OH)_nCl_{6-n}]_m \quad (2)$$

$$[Al(OH)_3]_nAlCl_3 \quad (3)$$

$$Al_n(OH)_mCl_{(3n-m)} \quad 0<m<3n \quad (4)$$

These water-soluble aluminum compounds are commercially available from Taki Chemical, K.K., Japan under the trade name of poly(aluminum chloride) (PAC, trade name) as a water treatment agent, from Asada Chemical K. K., Japan under the trade name of poly(aluminum hydroxide) (Paho, trade name), from K.K. Riken Green, Japan under the trade name of Pyurakemu WT (trade name) and other manufacturers with the same objects whereby various kinds of different grades can be easily obtained.

The water-soluble compound containing an element of Group 4 of the Periodic Table is not specifically limited so long as it is water-soluble, and a water-soluble compound containing titanium or zirconium is preferred. For example, as the water-soluble compound containing titanium, there may be mentioned titanium chloride and titanium sulfate, and as the water-soluble compound containing zirconium, there may be mentioned zirconium acetate, zirconium chloride, zirconium oxychloride, zirconium hydroxychloride, zirconium nitrate, basic zirconium carbonate, zirconium hydroxide, ammonium zirconium carbonate, potassium zirconium carbonate, zirconium sulfate, zirconium fluoride, and the like. Of these compounds, there is a compound having unsuitably low pH. In such a case, it may be used by optionally adjusting the pH of the compound. In the present invention, the term "water-soluble" means that the compound is dissolved in water in an amount of 1% by weight or more at normal temperature under normal pressure.

In the present invention, an amount of the above-mentioned water-soluble metallic compound is preferably about 0.1 to 10% by weight, more preferably about 1 to 5% by weight based on the amount of the inorganic fine particles.

The above-mentioned cationic compound may be used in combination of two or more compounds. For example, it is preferred to use the cationic polymer and the water-soluble metallic compound in combination.

In the ink-jet recording material of the present invention, high light resistance and gas resistance which cannot be accomplished by increasing amounts of the respective components can be accomplished by using a thioether compound in combination with the hydrazine compound.

The thioether compound to be used in the present invention is preferably a thioether compound having an alkyl group substituted by a hydrophilic group or a group containing a basic nitrogen atom, and there may be mentioned, for example, a compound represented by the following formula (5):

$$R^5—(S—R^7)_m—S—R^6 \quad (5)$$

wherein $R^5$ and $R^6$ may be the same or different from each other, each represents a hydrogen atom, a substituted or unsubstituted alkyl group, a substituted or unsubstituted aryl group or a group containing these alkyl group and the aryl group, or may form a ring by binding to each other, provided that at least one of $R^5$ and $R^6$ is an alkyl group substituted by a hydrophilic group such as a hydroxy group, a sulfo group, a carboxy group and a (poly)ethyleneoxy group, or a group containing a basic nitrogen atom such as an amino group, an amide group, an ammonium group, a nitrogen-containing heterocyclic group, an aminocarbonyl group and an aminosulfonyl group, or a group containing at least one of the above-mentioned these groups, and the substituted alkyl group may be bonded to the sulfur atom of the thioether through a divalent linking group such as a carbamoyl group, a carbonyl group, a carbonyloxy group, etc.; $R^7$ represents a substituted or unsubstituted alkylene group which may have an oxygen atom; and m is an integer of 0 to 10, and when m is 1 or more, at least one of the sulfur atom bonded to $R^7$ may be a sulfonyl group.

The above-mentioned thioether compound may be in the form of a salt such as a methanesulfonic acid salt, a p-toluenesulfonic acid salt, etc.

Particularly preferred compound represented by the formula (I) may include a compound wherein at least one of $R^5$ and $R^6$ is an alkyl group substituted by a hydroxy group, a carboxy group, an amino group or an ammonium group. As the amino group of the amino group-substituted alkyl group, there may be mentioned an amino group, a monoalkyl-substituted amino group (an alkyl group preferably being a $C_{1-5}$ alkyl), a dialkyl-substituted amino group (an alkyl preferably being a $C_{1-5}$ alkyl), etc., and it may be a nitrogen-containing heterocyclic group. In the following, specific examples of the compound represented by the formula (I) are mentioned but the present invention is not limited by these.

$$HO(CH_2)_3S(CH_2)_3OH \quad (1)$$

$$CH_3SCH_2\underset{\underset{NH_2}{|}}{C}HCOOH \quad (2)$$

$$HO(CH_2)_2S(CH_2)_2N(CH_3)_2 \quad (3)$$

$$HO(CH_2)_2S(CH_2)_2OH \quad (4)$$

$$CH_3S(CH_2)_2CH(NH_2)COOH \quad (5)$$

$$HO(CH_2)_2SCH_2S(CH_2)_2OH \quad (6)$$

-continued (7) $HO(CH_2)_2S(CH_2)_2S(CH_2)_2OH$ (8) $HO(CH_2)_2S(CH_2)_3S(CH_2)_2OH$ (9) $C_2H_5S(CH_2)_2SCH_2CH(OH)CH_2OH$

(10) $HOOCCH_2SCH_2SCH_2COOH$ (11)

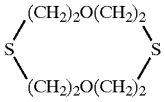

(12) $HO(CH_2)_2S(CH_2)_2SO_2(CH_2)_2S(CH_2)_2OH$

(13) $HO(CH_2)_3S(CH_2)_2S(CH_2)_3OH$

(14) $HOOCCH_2SCH_2COOH$

(15) $HOOCCH_2S(CH_2)_3SCH_2COOH$

(16) $HOOCCH_2S(CH_2)_2SCH_2COOH$

(17) $HO(CH_2)_2S(CH_2)_4S(CH_2)_2OH$

(18) $HO(CH_2)_2S(CH_2)_2S(CH_2)_2S(CH_2)_2OH$

(19) $HOOC(CH_2)_2S(CH_2)_2S(CH_2)_2COOH$

(20) $HOOC(CH_2)_2S(CH_2)S(CH_2)_2COOH$

(21) $(HO(CH_2)_2S(CH_2)_2)_2O$

(22) $H_2NCO(CH_2)_2S(CH_2)_2S(CH_2)_2CONH_2$

(23) $HOOC(CH_2)_2S(CH_2)_2COOH$

(24) $(HOCH_2CH(OH)CH_2SCH_2)_2$

(25) $HOOC(CH_2)_2S(CH_2)_3S(CH_2)_2COOH$

(26) $C_2H_5S(CH_2)_2S(CH_2)_2NHCO(CH_2)_2COOH$

(27) $HO(CH_2)_3S(CH_2)_2O(CH_2)_3O(CH_2)_2S(CH_2)_2OH$

(28) $HO(CH_2)_5S(CH_2)_5S(CH_2)_5OH$ (29)

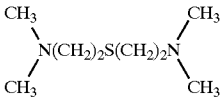

(30)

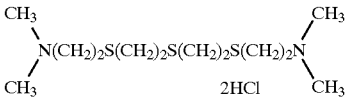

(31)

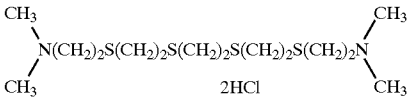

(32)

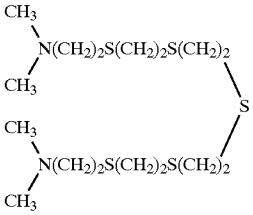

-continued (33)

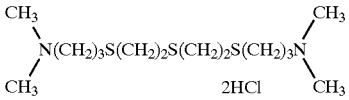

(34)

$H_2N(CH_2)_3S(CH_2)_2S(CH_2)_2S(CH_2)_3NH_2$

2HCl (35)

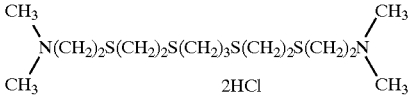

(36)

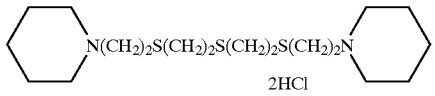

(37)

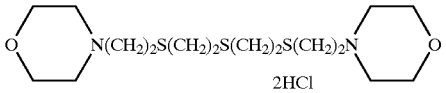

(38)

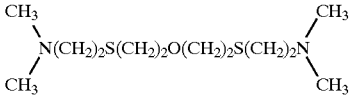

(39)

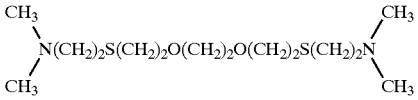

(40)

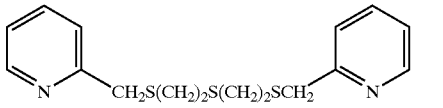

(41)

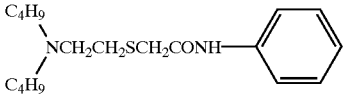

(42)

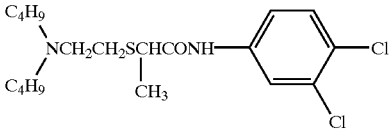

(43)

$(CH_3)_3\overset{\oplus}{N}(CH_2)_2S(CH_2)_2\overset{\oplus}{N}(CH_3)_3 \cdot 2\ CH_3SO_3^{\ominus}$ (44)

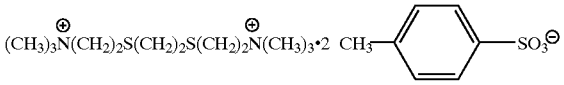

(45)

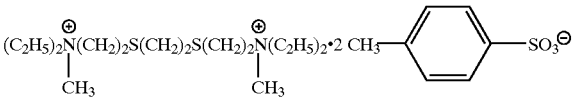

-continued (46)

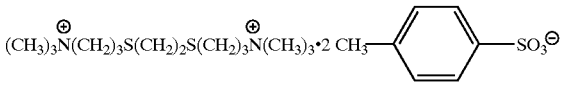

(47)

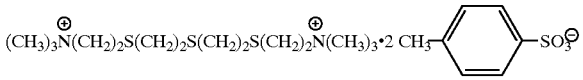

An amount of the above-mentioned thioether compound in the ink-receptive layer is preferably about 0.1 to 50 mmol/m$^2$, more preferably about 0.2 to 20 mmol/m$^2$.

In the present invention, the surface pH of the ink-receptive layer is a surface pH obtained by dropping distilled water on the surface of the ink-receptive layer and measuring the pH at the distilled water portion after 30 seconds from dropping according to the method described in J.TAPPI paper pulp testing method No. 49.

The surface pH of the ink-receptive layer is preferably adjusted in the state of the coating solution, but the pH of the coating solution and the surface pH of the dried film are not necessarily accorded with each other. Thus, it is necessary to previously obtain the relationship between the pH of the coating solution and that of the dried film using the coating solution by experiments to make the surface pH predetermined value. The pH of the coating solution for forming the ink-receptive layer can be adjusted by suitably using an acid and/or an alkali. As the acid to be used, there may be mentioned an inorganic acid such as hydrochloric acid, nitric acid, sulfuric acid, phosphoric acid, etc., and an organic acid such as acetic acid, citric acid, succinic acid, etc. As the alkali, there may be used sodium hydroxide, aqueous ammonia, potassium carbonate, trisodium phosphate, and as a weak alkali, an alkali metal salt of a weak acid such as sodium acetate, etc.

The ink-receptive layer of the present invention may further contain various kinds of oil droplets to improve brittleness of a film. As such oil droplets, there may be mentioned a hydrophobic organic solvent having a high boiling (for example, liquid paraffin, dioctyl phthalate, tricresyl phosphate, silicone oil, etc.) or polymer particles (for example, particles in which at least one of a polymerizable monomer such as styrene, butyl acrylate, divinyl benzene, butyl methacrylate, hydroxyethyl methacrylate, etc. is polymerized) each having a solubility in water at room temperature of 0.01% by weight or less. Such oil droplets can be used in an amount in the range of about 10 to about 50% by weight based on the amount of the hydrophilic binder.

In the present invention, a surfactant may be contained in the ink-receptive layer. The surfactant to be used may include either of an anionic, cationic, nonionic or betain type surfactant which may have a low molecular weight or a high molecular weight. At least one surfactant may be added to a coating solution for forming the ink-receptive layer. When two or more surfactants are used in combination, it is not preferred to use an anionic type together with a cationic type surfactant. An amount of the surfactant is preferably about 0.001 to about 5 g, more preferably about 0.01 to about 3 g per 100 g of the binder constituting the ink-receptive layer.

In the present invention, to the ink-receptive layer, various kinds of conventionally known additives such as a coloring dye, a coloring pigment, a fixing agent of an ink dye, an UV absorber, an antioxidant, a dispersant of the pigment, an antifoaming agent, a leveling agent, an antiseptic agent, a fluorescent brightener, a viscosity stabilizer, a pH buffer, etc. may be added.

A support to be used in the present invention is preferably a water resistant support. As the water resistant support to be used in the present invention, there may be mentioned, for example, a plastic resin film such as a polyester resin including polyethylene terephthalate; a diacetate resin; a triacetate resin; an acryl resin; a polycarbonate resin; a polyvinyl chloride; a polyimide resin; cellophane; celluloid; etc., a resin coated paper in which a polyolefin resin is laminated on the both surfaces of paper, and the like. A thickness of the water resistant support to be used in the present invention is preferably about 50 $\mu$m to about 300 $\mu$m.

A base paper constituting the resin-coated paper to be preferably used in the present invention is not particularly limited, and any paper generally used may be employed. More preferably a smooth base paper such as that used as a paper for a photographic support may be used. As pulp for constituting the base paper, natural pulp, regenerated pulp, synthetic pulp, etc. may be used singly or in combination of two or more. In the base paper, various additives conventionally used in the papermaking industry such as a sizing agent, a strengthening additive of paper, a loading material, an antistatic agent, a fluorescent brightener, a dye, etc. may be formulated.

Moreover, a surface sizing agent, a surface strengthening additive of paper, a fluorescent brightener, an antistatic agent, a dye, an anchoring agent, etc. may be coated on the surface of the sheet.

A thickness of the base paper is not particularly limited, and preferably that having a good surface smoothness prepared by compressing paper during paper-making or after paper-making by applying pressure using a calender, etc. A basis weight thereof is preferably about 30 to 250 g/m$^2$.

As a resin of the resin-coated paper, a polyolefin resin or a resin which cures by irradiation of electronic rays may be used. The polyolefin resin may include a homopolymer of an olefin such as low density polyethylene, high density polyethylene, polypropylene, polybutene, polypentene, etc.; a copolymer comprising two or more olefins such as an ethylene-propylene copolymer, etc.; or a mixture thereof, and these polymers having various densities and melt viscosity indexes (melt index) may be used singly or in combination of two or more.

Also, to the resin of the resin-coated paper, various kinds of additives including a white pigment such as titanium oxide, zinc oxide, talc, calcium carbonate, etc.; an aliphatic amide such as stearic amide, arachidamide, etc.; an aliphatic acid metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc,; a magenta-color pigment or dye such as cobalt violet, fast violet, manganese violet, etc.; a fluorescent brightener, an UV absorber, etc. may be preferably added optionally combining two or more.

The resin-coated paper to be preferably used in the present invention can be prepared, in the case of using a polyolefin resin, by casting a melted resin under heating on a running base paper, which is so-called the extrusion coating method, whereby the both surfaces of the base paper are coated by the resin. In the case of using a resin which cures by irradiation of electronic rays, the resin is coated on a base paper by means of a coater conventionally used such as a gravure coater, a blade coater, etc., then, electronic rays are irradiated to the resin whereby coating the base paper with the resin. Also, it is preferred to subject an activation treatment to a base paper before coating the resin to the base paper, such as a corona discharge treatment, a flame treatment, etc. The surface (the front surface) on which an ink-receptive layer is to be coated of the support is a gloss surface or a matte surface depending on the purposes, and particularly, a gloss surface is pre-ominantly used. It is not necessarily subjected to resin coating at the back surface of the base paper, but in view of preventing curl, it is preferred to coat the surface of the base paper with the resin. The back surface is usually a non-gloss surface, and if necessary, the activation treatment such as the corona discharge treatment, the flame treatment, etc. may be applied to the front surface or to the both surfaces of the front and back surfaces. Also, a thickness of the resin layer is not particularly limited, and is generally in the range of about 5 to about 50 $\mu$m on the front surface or both of the front and back surfaces.

To the support of the present invention, various kinds of back coating layer(s) may be provided for the purpose of providing antistatic property, conveying property, anticurl property, etc. to the support. In the back coating layer, an inorganic antistatic agent, an organic antistatic agent, a hydrophilic binder, a latex, a curing agent, a pigment, a surfactant, etc. may be included in optional combination.

In the present invention, the coating method of the ink-receptive layer is not particularly limited, and a coating method conventionally known in the art may be used. For example, there may be mentioned a slidelip system, a curtain system, an extrusion system, an air knife system, a roll coating system, a rod bar coating system, etc.

To the ink-jet recording material of the present invention, in addition to the layer containing fumed silica (this layer may comprise two or more layers), an ink-absorbing layer, an ink-fixing layer, an intermediate layer, a protective layer, etc., may be further provided. For example, a water-soluble polymer layer may be provided as an under layer or a swelling layer may be provided as an upper layer. Particularly by providing a porous upper layer comprising alumina hydrate is provided with a coating amount less than the fumed silica at the lower layer, an ink-jet recording material having high printing density and excellent preservability can be obtained.

EXAMPLES

In the following, the present invention is explained in more detail by referring to Examples, but the present invention is not limited by these Examples. Incidentally, in the following examples, all "part(s)" mean "part(s) by weight" of a solid component.

Example 1

A mixture of a bleached kraft pulp of hardwood (LBKP) and a bleached sulfite pulp of hardwood (NBSP) with a ratio of 1:1 was subjected to beating until it becomes 300 ml by the Canadian Standard Freeness to prepare a pulp slurry. To the slurry were added alkyl ketene dimer in an amount of 0.5% by weight based on the amount of the pulp as a sizing agent, polyacrylamide in an amount of 1.0% by weight based on the same as a strengthening additive of paper, cationic starch in an amount of 2.0% by weight based on the same, and polyamide epichlorohydrin resin in an amount of 0.5% by weight based on the same, and the mixture was diluted by water to prepare a 1% by weight slurry. This slurry was made paper by a tourdrinier paper machine to have a basis weight of 170 g/m$^2$, dried and subjected to moisture conditioning to prepare a base paper for a polyolefin resin-coated paper.

A polyethylene resin composition comprising 100% by weight of a low density polyethylene having a density of 0.918 g/cm$^3$ and 10% by weight of anatase type titanium oxide dispersed uniformly in the resin was melted at 320° C. and the melted resin composition was subjected to extrusion coating on the above-mentioned base paper with a thickness of 35 $\mu$m by 200 m/min and subjected to extrusion coating by using a cooling roll subjected to slightly roughening treatment. On the other surface of the base paper, a resin composition comprising 70 parts by weight of a high density polyethylene resin having a density of 0.962 g/cm$^3$ and 30 parts by weight of a low density polyethylene resin having a density of 0.918 g/cm$^3$ was melted at 320° C. and the melted resin composition was subjected to extrusion coating with a thickness of 30 $\mu$m and subjected to extrusion coating by using a cooling roll subjected to roughening treatment.

To the front surface of the above-mentioned polyolefin resin-coated paper was subjected to high frequency corona discharge treatment, and then, the following subbing layer composition was coated thereon with a gelatin amount of 50 mg/m$^2$ and dried to prepare a support.

An aqueous solution containing fumed silica and Sharol DC902P was dispersed by a high pressure homogenizer, and polyvinyl alcohol and others are added to the aqueous solution to prepare an ink-receptive layer having the following composition. Then, the mixture was coated so that a coated amount of the fumed silica became 18 g/m$^2$ and dried to prepare an ink-jet recording sheet. Incidentally, each recording sheet was so adjusted that the surface pH of the ink-receptive layer became 4.0.

<Recording Sheet 1>

| | |
|---|---|
| Fumed silica (Average primary particle size: 7 nm, Specific surface area by the BET method: 300 m$^2$/g) | 100 parts |
| Polyvinyl alcohol (PVA235, trade name, available from K.K. Kuraray, Japan, Saponification degrees: 88%, Average polymerization degree: 3,500) | 25 parts |
| Boric acid | 4 parts |
| Amphoteric surfactant (SWAM AM-2150, trade name, available form Nippon Surfactant, Japan | 0.3 part |

<Recording Sheet 2>

To the ink-receptive layer of the above-mentioned Recording sheet 1, 5 mmol/m$^2$ of urea was added.

<Recording Sheet 3>

To the ink-receptive layer of the above-mentioned Recording sheet 1, 5 mmol/m$^2$ of diethyldithiocarbamic acid was added.

<Recording Sheet 4>

To the ink-receptive layer of the above-mentioned Recording sheet 1, 5 mmol/m$^2$ of thiosemicarbazide was added.

<Recording Sheet 5>

To the ink-receptive layer of the above-mentioned Recording sheet 1, 5 mmol/m$^2$ of the hydrazine compound (5) of the present invention was added.

<Recording Sheet 6>

To the ink-receptive layer of the above-mentioned Recording sheet 1, 5 mmol/m$^2$ of the hydrazine compound (15) of the present invention was added.

<Recording Sheet 7>

To the ink-receptive layer of the above-mentioned Recording sheet 1, 5 mmol/m$^2$ of the hydrazine compound (16) of the present invention was added.

<Recording Sheet 8>

To the ink-receptive layer of the above-mentioned Recording sheet 1, 5 mmol/m$^2$ of the hydrazine compound (23) of the present invention was added.

<Recording Sheet 9>

To the ink-receptive layer of the above-mentioned Recording sheet 1, 5 mmol/m$^2$ of the hydrazine compound (27) of the present invention was added.

With regard to the respective ink-jet recording sheets thus obtained, ink-absorption property, water resistance, preservability (light resistance and gas resistance) after printing, and glossiness were evaluated. The results are shown in Table 1.

<Ink-absorption Property>

C (cyan), M (magenta) and Y (yellow) were each printed with 100% by an ink-jet printer (PM-800C, trade name, available from Seiko Epson K.K., Japan), and immediately after the printing, a PPC paper was overlapped over the printed portion with a slight pressurization, and the degree of an amount of the ink transferred to the PPC paper was observed with naked eyes and evaluated according to the following standards.

○: No transfer was observed.

X: Transfer was occurred.

<Water Resistance>

Printing was carried out with fine lines each having a width of 100 μm with a line distance of 100 μm, and the printed paper was allowed to stand one day. Then, the printed paper was placed under the conditions of 35° C. and 90% relative humidity (RH) for 2 days, and blur of fine lines was evaluated according to the following standards.

○: Substantially no blur and intervals between fine lines are clear.

Δ: There are blur but intervals between fine lines are not completely disappeared.

X: Fine lines are blurred and no interval appears.

<Light Resistance>

Printing was carried out on the whole surface of a paper with ink of C, Y, M or K (black) by using by an ink-jet printer (PM-770C, trade name, available from Seiko Epson K.K., Japan), respectively, followed by irradiating light of 600 W/m$^2$ to the printed materials for 30 hours by SunTest CPS light-fading test machine (trade name) manufactured by Atlas K.K., Japan. Thereafter, the density at the printed portion was measured and the image remaining ratio (density after irradiation/density before irradiation) was obtained. Among the images of C, M, Y and K, the lowest remaining ratio was shown.

<Gas Resistance>

Printing was carried out in the same manner as in the above-mentioned light resistance test. After exposing the material in air at room temperature for 3 months, the density at the printed portion was measured. The image remaining ratio (density after exposure/density before exposure) was obtained. Among the images of C, M, Y and K, the lowest remaining ratio was shown.

<Glossiness>

Glossiness was measured according to the method described in JIS P-8142 (Testing method for 750 specular glossiness of paper and board).

TABLE 1

| | Ink | | Preservability (%) | | |
|---|---|---|---|---|---|
| Recording sheet | absorption property | Water resistance | Light resistance | Gas resistance | Remarks |
| 1 | ○ | ○ | 76 | 73 | Comparative |
| 2 | ○ | ○ | 76 | 74 | Comparative |
| 3 | ○ | ○ | 71 | 82 | Comparative |
| 4 | ○ | ○ | 74 | 90 | Comparative |

TABLE 1-continued

| | Ink | | Preservability (%) | | |
|---|---|---|---|---|---|
| Recording sheet | absorption property | Water resistance | Light resistance | Gas resistance | Remarks |
| 5 | ○ | ○ | 84 | 86 | This invention |
| 6 | ○ | ○ | 92 | 88 | This invention |
| 7 | ○ | ○ | 91 | 89 | This invention |
| 8 | ○ | ○ | 90 | 87 | This invention |
| 9 | ○ | ○ | 92 | 88 | This invention |

Respective recording sheets showed glossiness of 60 to 65% and high glossiness was shown. As can be clearly seen from the results shown in Table 1, by using the hydrazine compound of the present invention, light resistance and gas resistance could be improved while maintaining high ink absorption property and high water resistance. That is, in the present invention, the ink absorption property, water resistance and preservability are simultaneously improved and a photo-like high glossiness can be obtained.

Example 2

The same tests were carried out as in Example 1 except for changing fumed silica used in Example 1 to those having an average primary particle size of 15 nm. As a result, substantially the same results could be obtained with regard to ink absorption property and preservability, but glossiness was lowered with the degree of 3 to 6%.

Example 3

The same tests were carried out as in Example 1 except for using a polyester film as a support. As a result, substantially the same results as in Example 1 could be obtained

Example 4

On the support used in Example 1 were coated the two kinds of coating solutions for preparing ink-receptive layers A and B having the compositions mentioned below simultaneously by a slide bead coating apparatus, and dried. The ink-receptive layer A which is a lower layer near to the support and the ink-receptive layer B which is for an upper layer as mentioned below were prepared by dispersing inorganic fine particles so that they are concentrations of 9% by weight of the solid component by a high pressure homogenizer. These coating solutions were so coated that an amount of the fumed silica in the ink-receptive layer A becomes 16 g/m$^2$ in a solid content, and an amount of the pseudo boehmite in the ink-receptive layer B becomes 4 g/m$^2$ in a solid content, and dried (Recording sheet 1A).

<Coating Solution for Ink-Receptive Layer A>

| | |
|---|---|
| Fumed silica (average particle size of primary particle: 7 nm) | 100 parts |
| Dimethyldiallyl ammonium chloride polycondensate (available from Daiichi Kogyo Seiyaku K.K., Japan, Sharol (DC902P, trade name) | 4 parts |

-continued

| | |
|---|---|
| Boric acid | 4 parts |
| Polyvinyl alcohol (Saponification degree: 88%, average polymerization degree: 3500) | 20 parts |
| Surfactant | 0.3 part |
| Zirconium acetate | 2 parts |

<Coating Solution for Ink-Receptive Layer B>

| | |
|---|---|
| Pseudo boehmite (average particle size of primary particle: 15 nm, platy shape with an aspect ratio of 5) | 100 parts |
| Boric acid | 4 parts |
| Polyvinyl alcohol (Saponification degree: 88%, average polymerization degree: 3500) | 20 parts |
| Surfactant | 0.3 part |
| Zirconium acetate | 2 parts |

Drying conditions after the coating are shown below.

After cooling at 5° C. for 30 seconds, drying was carried out at 45° C. and 10% RH (relative humidity) until the total concentration of the solid components is 90% by weight, and then, at 35° C. and 10% RH.

To the ink-receptive layer A and the ink-receptive layer B were added each 5 mmol/$m^2$ of the urea, diethyldithiocarbamic acid, thiosemicarbazide or hydrazine compounds used in Recording sheets 2 to 9 of Example 1, whereby Recording sheets 2A to 9A were prepared, respectively.

With regard to the ink-jet recording sheets prepared as mentioned above, the following evaluation was carried out. Ink absorption property, light resistance and gas resistance were carried out in the same manner as in Example 1. The results are shown in Table 2.

<Density at Printed Portion>

Printing density at the black solid portion was measured by Macbeth reflection densitometer and an average value of 5-times measurements is shown.

TABLE 2

| Recording sheet | Ink-absorption property | Density at printed portion | Preservability (%) Light resistance | Preservability (%) Gas resistance | Remarks |
|---|---|---|---|---|---|
| 1 | ○ | 2.12 | 76 | 73 | Comparative |
| 1A | ○ | 2.21 | 78 | 74 | Comparative |
| 2A | ○ | 2.22 | 77 | 74 | Comparative |
| 3A | ○ | 2.21 | 70 | 81 | Comparative |
| 4A | ○ | 2.20 | 72 | 91 | Comparative |
| 5A | ○ | 2.20 | 85 | 87 | This invention |
| 6A | ○ | 2.22 | 93 | 88 | This invention |
| 7A | ○ | 2.21 | 91 | 89 | This invention |
| 8A | ○ | 2.22 | 91 | 87 | This invention |
| 9A | ○ | 2.22 | 92 | 89 | This invention |

Example 5

In the same manner as in Example 1 except for changing the formulation of the ink-receptive layer as mentioned below, the same procedure as in Example 1 was carried out.

<Recording Sheet 10>

| | |
|---|---|
| Fumed silica (Average primary particle size: 7 nm, Specific surface area by the BET method: 300 $m^2$/g) | 100 parts |
| Dimethyldiallyl ammonium chloride polycondensate (available from Daiichi Kogyo Seiyaku K.K., Japan, Sharol DC902P, trade name) | 3 parts |
| Polyvinyl alcohol (PVA235, trade name, available from K.K. Kuraray, Japan, Saponification degree: 88%, Average polymerization degree: 3,500) | 25 parts |
| Basic polyaluminum hydroxide (Pyurakemu WT, trade name, available from Riken Green K.K.) | 3 parts |
| Alkylamine epichlorohydrin polycondensate (quaternary degree: 80%, average molecular weight: 7000) | 4 parts |
| Boric acid | 4 parts |
| Amphoteric surfactant (SWAM AM-2150, trade name, available from Nippon Surfactant, Japan) | 0.3 part |

<Recording Sheet 11>

To the ink-receptive layer of the above-mentioned Recording sheet 10, 3.5 mmol/$m^2$ of the hydrazine compound (27) of the present invention was added.

<Recording Sheet 12>

To the ink-receptive layer of the above-mentioned Recording sheet 10, 7 mmol/$m^2$ of the hydrazine compound (27) of the present invention was added.

<Recording Sheet 13>

To the ink-receptive layer of the above-mentioned Recording sheet 10, 3.5 mmol/$m^2$ of thioether compound (24) was added.

<Recording Sheet 14>

To the ink-receptive layer of the above-mentioned Recording sheet 10, 7 mmol/$m^2$ of the thioether compound (24) was added.

<Recording Sheet 15>

To the ink-receptive layer of the above-mentioned Recording sheet 10, 0.3 mmol/$m^2$ of the dicyandiamide resin (Jetfix 20) was added.

<Recording Sheet 16>

To the ink-receptive layer of the above-mentioned Recording sheet 10, 0.6 mmol/$m^2$ of the dicyandiamide resin (Jetfix 20) was added.

<Recording Sheet 17>

To the ink-receptive layer of the above-mentioned Recording sheet 10, 3.5 mmol/$m^2$ of the hydrazine compound (27) of the present invention and 3.5 mmol/$m^2$of the thioether compound (24) were added.

<Recording Sheet 18>

To the ink-receptive layer of the above-mentioned Recording sheet 10, 3.5 mmol/$m^2$ of the hydrazine compound (27) of the present invention and 0.3 mmol/$m^2$ of the dicyandiamide resin (Jetfix 20) were added.

With regard to the resulting respective ink-jet recording sheets, ink-absorption property, water resistance, preservability after printing (light resistance and gas resistance), and glossiness were measured in the same manner as in Example 1. The results are shown in Table 3.

TABLE 3

| Recording sheet | Ink absorption property | Water resistance | Preservability (%) Light resistance | Gas resistance | Remarks |
|---|---|---|---|---|---|
| 10 | ○ | ○ | 77 | 73 | Comparative |
| 11 | ○ | ○ | 90 | 86 | This invention |
| 12 | ○ | ○ | 92 | 89 | This invention |
| 13 | ○ | ○ | 76 | 87 | Comparative |
| 14 | ○ | ○ | 73 | 90 | Comparative |
| 15 | ○ | ○ | 65 | 92 | Comparative |
| 16 | ○ | ○ | 61 | 94 | Comparative |
| 17 | ○ | ○ | 91 | 89 | This invention |
| 18 | ○ | ○ | 89 | 94 | This invention |

According to the present invention, a photo-like ink-jet recording material having high ink-absorption property, high water resistance, high glossiness and improved in preservability can be obtained.

What is claimed is:

1. An ink-jet recording material which comprises a water resistant support, and a porous ink-receptive layer containing inorganic fine particles having an average particle size of primary particles of 30 nm or less provided on the support, wherein said ink-jet recording material contains at least one hydrazine compound which is represented by the formula (1):

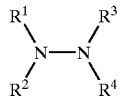

(1 wherein $R^1$ to $R^4$ each independently represents a hydrogen atom, a substituted or unsubstituted aliphatic group, an aromatic group, a heterocyclic group, a carbonyl group, a sulfonyl group, a sulfoxy group, a phosphoryl group, or an iminomethylene group, each of which may be bonded to form a ring, or may form a polymer.

2. The ink-jet recording material according to claim 1, wherein the inorganic fine particles are fumed silica.

3. The ink-jet recording material according to claim 1, wherein the ink-receptive layer is cross-linked by a cross-linking agent.

4. The ink-jet recording material according to claim 1, wherein a surface pH of the ink-jet recording material is 3 to 6.

5. The ink-jet recording material according to claim 1, wherein the material further contains a thioether compound.

6. The ink-jet recording material according to claim 1, wherein the material further contains a dicyane diamide resin.

7. The ink-jet recording material according to claim 1, wherein at least one of $R^1$ to $R^4$ is a substituted or unsubstituted carbonyl group or sulfonyl group.

8. The ink-jet recording material according to claim 1, wherein the hydrazine compound is contained in the ink-receptive layer.

9. The ink-jet recording material according to claim 1, wherein the hydrazine compound is contained in an amount of 0.1 to 50 mmol/$m^2$.

10. The ink-jet recording material according to claim 1, wherein the hydrazine compound is contained in an amount of 0.2 to 20 mmol/$m^2$.

11. The ink-jet recording material according to claim 1, wherein the inorganic fine particles are fumed silica.

12. The ink-jet recording material according to claim 1, wherein the ink-receptive layer is cross-linked by a cross-linking agent.

13. The ink-jet recording material according to claim 1, wherein a surface pH of the ink-jet recording material is 3 to 6.

14. The ink-jet recording material according to claim 1, wherein the material further contains a thioether compound.

15. The ink-jet recording material according to claim 1, wherein the material further contains a dicyane diamide resin.

16. The ink-jet recording material according to claim 5, wherein the thioether compound is represented by the formula (5):

$$R^5—(S—R^7)_m—S—R^6 \quad (5)$$

wherein $R^5$ and $R^6$ may be the same or different from each other and each represents a hydrogen atom, a substituted or unsubstituted alkyl group, a substituted or unsubstituted aryl group or a group containing these alkyl group and the aryl group, or may form a ring by binding to each other, provided that at least one of $R^5$ and $R^6$ is an alkyl group substituted by a hydrophilic group selected from a hydroxy group, a sulfo group, a carboxy group and a (poly)ethyleneoxy group, or a group containing a basic nitrogen atom selected from an amino group, an amide group, an ammonium group, a nitrogen-containing heterocyclic group, an aminocarbonyl group and an aminosulfonyl group, or a group containing at least one of the above-mentioned these groups, and the substituted alkyl group may be bonded to the sulfur atom of the thioether through a divalent linking group; $R^7$ represents a substituted or unsubstituted alkylene group which may have an oxygen atom; and m is an integer of 0 to 10, and when m is 1 or more, at least one of the sulfur atom bonded to $R^7$ may be a sulfonyl group.

17. An ink-jet recording material which comprises a water resistant support, and a porous ink-receptive layer containing inorganic fine particles having an average particle size of primary particles of 30 nm or less provided on the support, wherein said ink-jet recording material contains at least one hydrazine compound and said ink-jet recording material further contains a dicyane diamide resin.

18. The ink-jet recording material according to claim 17, wherein the inorganic fine particles are fumed silica.

19. The ink-jet recording material according to claim 17, wherein the ink-receptive layer is cross-linked by a cross-linking agent.

20. The ink-jet recording material according to claim 17, wherein a surface pH of the ink-jet recording material is 3 to 6.

21. The ink-jet recording material according to claim 17, wherein the material further contains a thioether compound.

22. The ink-jet recording material according to claim 17, wherein the hydrazine compound is represented by the formula (1):

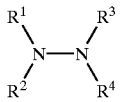

(1 wherein $R^1$ to $R^4$ each independently represents a hydrogen atom, a substituted or unsubstituted aliphatic group, an aromatic group, a heterocyclic group, a carbonyl group, a sulfonyl group, a sulfoxy group, a phosphoryl group, or an iminomethylene group, each of which may be bonded to form a ring, or may form a polymer.

23. The ink-jet recording material according to claim 22, wherein at least one of $R^1$ to $R^4$ is a substituted or unsubstituted carbonyl group or sulfonyl group.

24. The ink-jet recording material according to claim 17, wherein the hydrazine compound is contained in the ink-receptive layer.

25. The ink-jet recording material according to claim 17, wherein the hydrazine compound is contained in an amount of 0.1 to 50 mmol/$m^2$.

26. The ink-jet recording material according to claim 17, wherein the hydrazine compound is contained in an amount of 0.2 to 20 mmol/$m^2$.

27. An ink-jet recording material which comprises a water resistant support, and a porous ink-receptive layer containing inorganic fine particles having an average particle size of primary particles of 30 nm or less provided on the support, wherein said ink-jet recording material contains at least one hydrazine compound in an amount of 0.1 to 50 mmol/$m^2$ and which is represented by the formula (1):

(1

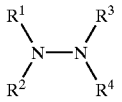

wherein $R^1$ to $R^4$ each independently represents a hydrogen atom, a substituted or unsubstituted aliphatic group, an aromatic group, a heterocyclic group, a carbonyl group, a sulfonyl group, a sulfoxy group, a phosphoryl group, or an iminomethylene group, each of which may be bonded to form a ring, or may form a polymer.

28. The ink-jet recording material according to claim 27, wherein the inorganic fine particles are fumed silica.

29. The ink-jet recording material according to claim 27, wherein the ink-receptive layer is cross-linked by a cross-linking agent.

30. The ink-jet recording material according to claim 27, wherein a surface pH of the ink-jet recording material is 3 to 6.

31. The ink-jet recording material according to claim 27, wherein the material further contains a thioether compound.

32. The ink-jet recording material according to claim 27, wherein the material further contains a dicyane diamide resin.

33. The ink-jet recording material according to claim 27, wherein at least one of $R^1$ to $R^4$ is a substituted or unsubstituted carbonyl group or sulfonyl group.

34. The ink-jet recording material according to claim 27, wherein the hydrazine compound is contained in the ink-receptive layer.

35. The ink-jet recording material according to claim 27, wherein the hydrazine compound is contained in an amount of 0.2 to 20 mmol/$m^2$.

36. An ink-jet recording material which comprises a water resistant support, and a porous ink-receptive layer containing inorganic fine particles having an average particle size of primary particles of 30 nm or less provided on the support, wherein said ink-jet recording material contains at least one hydrazine compound and wherein said ink-jet recording material further contains a thioether compound which is represented by the formula (5):

$$R^5—(S—R^7)_m—S—R^6 \quad (5)$$

wherein $R^5$ and $R^6$ may be the same or different from each other and each represents a hydrogen atom, a substituted or unsubstituted alkyl group, a substituted or unsubstituted aryl group or a group containing these alkyl group and the aryl group, or may form a ring by binding to each other, provided that at least one of $R^5$ and $R^6$ is an alkyl group substituted by a hydrophilic group selected from a hydroxy group, a sulfo group, a carboxy group and a (poly)ethyleneoxy group, or a group containing a basic nitrogen atom selected from an amino group, an amide group, an ammonium group, a nitrogen-containing heterocyclic group, an aminocarbonyl group and an aminosulfonyl group, or a group containing at least one of the above-mentioned these groups, and the substituted alkyl group may be bonded to the sulfur atom of the thioether through a divalent linking group; $R^7$ represents a substituted or unsubstituted alkylene group which may have an oxygen atom; and m is an integer of 0 to 10, and when m is 1 or more, at least one of the sulfur atom bonded to $R^7$ may be a sulfonyl group.

37. The ink-jet recording material according to claim 36, wherein the inorganic fine particles are fumed silica.

38. The ink-jet recording material according to claim 36, wherein the ink-receptive layer is cross-linked by a cross-linking agent.

39. The ink-jet recording material according to claim 36, wherein a surface pH of the ink-jet recording material is 3 to 6.

40. The ink-jet recording material according to claim 36, wherein the material further contains a dicyane diamide resin.

41. The ink-jet recording material according to claim 36, wherein the hydrazine compound is represented by the formula (1):

(1

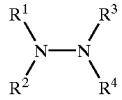

wherein $R^1$ to $R^4$ each independently represents a hydrogen atom, a substituted or unsubstituted aliphatic group, an aromatic group, a heterocyclic group, a carbonyl group, a sulfonyl group, a sulfoxy group, a phosphoryl group, or an iminomethylene group, each of which may be bonded to form a ring, or may form a polymer.

42. The ink-jet recording material according to claim 41, wherein at least one of $R^1$ to $R^4$ is a substituted or unsubstituted carbonyl group or sulfonyl group.

43. The ink-jet recording material according to claim 36, wherein the hydrazine compound is contained in the ink-receptive layer.

44. The ink-jet recording material according to claim 36, wherein the hydrazine compound is contained in an amount of 0.1 to 50 mmol/$m^2$.

45. The ink-jet recording material according to claim 36, wherein the hydrazine compound is contained in an amount of 0.2 to 20 mmol/$m^2$.

* * * * *